US006108509A

United States Patent [19]

Okada et al.

[11] Patent Number: 6,108,509

[45] Date of Patent: Aug. 22, 2000

[54] TONER CARRIER AND IMAGE-FORMING APPARATUS

[75] Inventors: Tokuo Okada, Kodaira; Koji Takagi, Kawasaki; Hiroshi Kaneda; Toshiaki Arai, both of Kodaira; Takahiro Kawagoe, Tokorozawa, all of Japan

[73] Assignee: Bridgestone Corporation, Tokyo, Japan

[21] Appl. No.: 09/334,639

[22] Filed: Jun. 17, 1999

[30] Foreign Application Priority Data

Jun. 17, 1998 [JP] Japan ..... 10-170038

[51] Int. Cl.[7] ..... G03G 15/08

[52] U.S. Cl. ..... 399/286

[58] Field of Search ..... 399/286, 266, 399/276, 277, 222, 284, 285; 492/8, 16, 38, 49, 56; 430/101, 120; 118/653, 657, 658; 428/335, 332

[56] References Cited

U.S. PATENT DOCUMENTS

| | | | |
|---|---|---|---|
| 4,994,319 | 2/1991 | Nojima et al. | 399/222 X |
| 5,099,285 | 3/1992 | Hirano et al. | 399/266 |
| 5,168,312 | 12/1992 | Aoto et al. | 399/284 |
| 5,255,057 | 10/1993 | Stelter et al. | 399/285 |

*Primary Examiner*—Arthur T. Grimley
*Assistant Examiner*—Hoan Tran
*Attorney, Agent, or Firm*—Sughrue, Mion, Zinn, Macpeak & Seas, PLLC

[57] ABSTRACT

A toner carrier which gives good images (free of fogging in white area, harshness in halftone area, and density variation in black area) even after continuous long runs. The toner carrier includes an electrically conductive elastic layer and a coating layer formed thereon which contains a siloxane-crosslinked acrylic resin obtained from an acrylic copolymer with an alkoxysilyl group by crosslinking and curing.

6 Claims, 1 Drawing Sheet

TONER CARRIER AND IMAGE-FORMING APPARATUS

BACKGROUND OF THE INVENTION

1. Field of the Invention

The present invention relates to a toner carrier and an image-forming apparatus (such as copying machines and laser printers) equipped with said toner carrier. The toner carrier supplies a toner to the image-forming body, such as photosensitive body which holds an electrostatic latent image and paper, thereby forming a visible image on the image forming body. More particularly, the present invention relates to a toner carrier, which is durable for a long time and capable of giving high-quality images, and an image-forming apparatus equipped with said toner carrier.

2. Description of the Related Art

Conventional image-forming apparatus such as copying machines and printers, which are based on electrophotography, employs the pressure development method to form visible images. This method is designed to supply a one-component toner to the image-forming body (such as photosensitive body), which holds an electrostatic latent image, so that the toner attaches itself to the latent image, thereby making it visible. (See U.S. Pat. Nos. 3,152,012 and 3,731,146.)

According to the pressure development method, the toner carrier (carrying a toner) is brought into contact with the image-forming body (or photosensitive body) holding an electrostatic latent image such that the toner attaches itself to the latent image on the image-forming body, thereby forming an image. For this reason, the toner carrier should be formed from an electrically conductive elastic material.

As FIG. 2 shows, the pressure development method works in the following way. A toner carrier 1 (or a development roll) is installed between a toner applying roll 5 to supply a toner and an image-forming body 6 (or a photosensitive body) to hold an electrostatic latent image. The toner carrier 1, the image-forming body 6, and the toner applying roll 5 turn in the direction of arrows. Thus, the toner applying roll 5 supplies the toner 7 to the surface of the toner carrier 1. The toner supplied is uniformly spread into a thin layer by the layer forming blade 8. As the toner carrier 1 turns, staying in contact with the image-forming body 6, the toner thin layer transfers from the toner carrier 1 to the latent image on the image-forming body 6. Thus, the latent image becomes visible. Incidentally, there are shown in FIG. 2 a transfer part 9, which transfers a toner image to a recording medium such as paper, and a cleaning station 10, which has a cleaning blade 11 to remove residual toner remaining on the surface of the image forming body 6 after transfer.

During this procedure, the toner carrier 1 should turn while staying in close contact with the image-forming body 6. Consequently, the toner carrier 1 consists of a shaft 2 of good conducting material (such as metal) and an electrically conductive elastic layer 3 formed thereon, as shown in FIG. 1. The layer 3 is formed from an elastic rubber or foam (such as silicone rubber, NBR, EPDM, and polyurethane rubber) incorporated with an electrically conducting agent. The layer 3 is covered with a surface coating layer 4 of resin. The coating layer 4 regulates the degree of charging and sticking of the toner 7 and also regulates friction with the image forming body 6 and the layer forming blade 8. Further, it prevents the photosensitive body from contamination with the elastic material.

Another image-forming method has been proposed as disclosed in Japanese Patent Laid-open No. 116559/1983.

This method employs a non-magnetic toner which is spread in thin layer on the surface of the toner carrier (in sleeve form). The toner carrier is arranged near the image-forming body (photosensitive body) without contact. The non-magnetic toner flies to the photosensitive body for development and image forming.

There is another image-forming method proposed. This method employs paper or OHP sheet as the image-forming body. The toner held on the toner carrier is allowed to fly directly to this image-forming body through holes made in a control electrode, so that an image is formed directly on paper or OHP sheet.

The above-mentioned image-forming method that employs a sleeve-like toner carrier or a control electrode also has the toner carrier coated with an electrically conductive elastic layer of resin. This coating layer regulates the degree of charging and sticking of the toner and also regulates friction with the image forming body, the layer forming blade, and the control electrode.

It has been proposed to make the coating layer on the surface of the toner carrier from melamine resin, phenolic resin, alkyd resin, fluorocarbon resin, polyamide resin, or the like. The coating layer of these resins will reduce friction of the toner carrier and improve image quality.

Requirements for image-forming have become very stringent recently as the printing speed increases, the image becomes finer than before, and the monochrome image is replaced by the color one. These present a problem which cannot be solved by the conventional toner carrier. When the toner carrier incorporated into the image-forming apparatus is used for a long period of time, image defects occur as the number of print runs increases. The image defects include fogging in white images, harshness in halftone images, and density variation in black images.

OBJECT AND SUMMARY OF THE INVENTION

The present invention was completed in view of the foregoing. It is an object of the present invention to provide a toner carrier and an image-forming apparatus equipped with said toner carrier. This toner carrier does not cause image defects (such as fogging in white areas, harshness in halftone areas, and density variation in black areas) even after use for a long period of time. In addition, the toner carrier forms good images over an extended period and is superior in durability.

DESCRIPTION OF THE PREFERRED EMBODIMENTS

Figure 2:
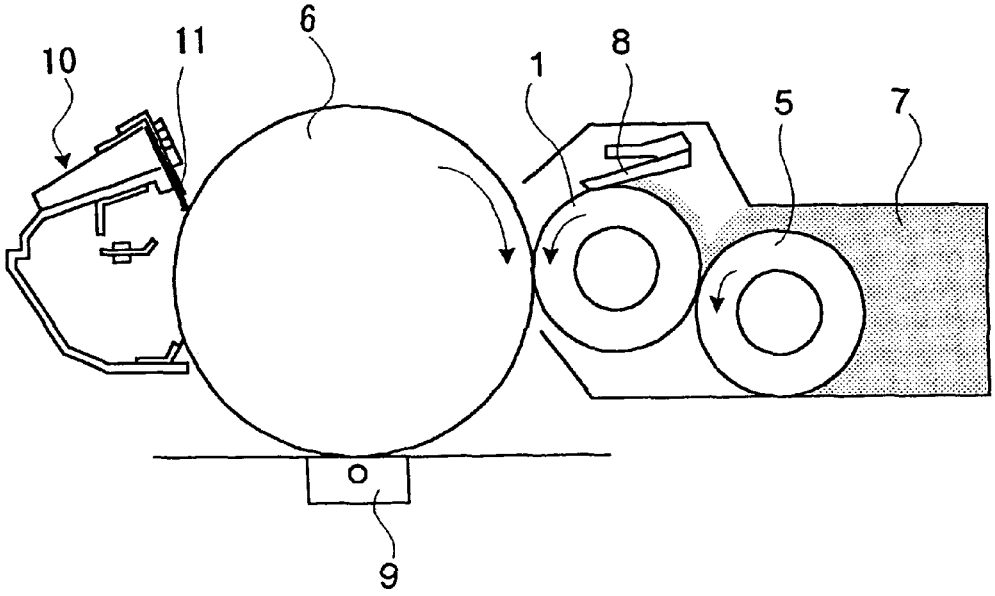
FIG. 2 is a schematic diagram showing the image-forming apparatus pertaining to one embodiment of the present invention.

In order to achieve the above-mentioned object, the present inventors carried out a series of researches, which led to the finding that image defects (such as fogging in white areas, harshness in halftone areas, and density variation in black areas) occur after prolonged run from the following cause. The toner carrier (or development roll) installed in the image-forming apparatus as shown in FIG. 2 has its surface coating layer worn after prolonged use. This wearing is due to friction with the toner, the toner applying roll, and the layer forming blade. As a result, the surface state of the toner carrier changes, causing variation in the amount of static charge of the toner or the amount of transfer of the toner. This in turn results in image defects such as fogging in white areas, harshness in halftone areas, and density variation in black areas.

The present inventors searched for materials suitable for the coating layer that meets the following requirements. It should be highly resistant to friction with the toner, the toner applying roll, and the layer forming blade. It should keep its surface state unchanged even after prolonged use. It should protect the photosensitive body from staining, prevent the sticking of the toner, regulate the degree of charging and resistance of the toner, and regulate the coefficient of friction. As a result, it was found that these requirements are met by a siloxane-crosslinked acrylic resin which is formed by crosslinking and curing an acrylic copolymer containing an alkoxysilyl group. The present invention was completed on the basis of this finding.

The present invention covers a toner carrier which carries a toner in such a way as to form a thin layer of said toner on the surface thereof, touches or approaches an image-forming body with said toner carried thereon, and supplies said toner to the surface of said image-forming body, thereby forming a visible image on the surface of said image-forming body, wherein said toner carrier comprises an electrically conductive elastic layer and a coating layer formed thereon which contains siloxane-crosslinked acrylic resin obtained from an acrylic copolymer with an alkoxysilyl group by crosslinking and curing.

The present invention also covers an image-forming apparatus which is equipped with the above-defined toner carrier.

A detailed description of the invention follows.

Figure 1:
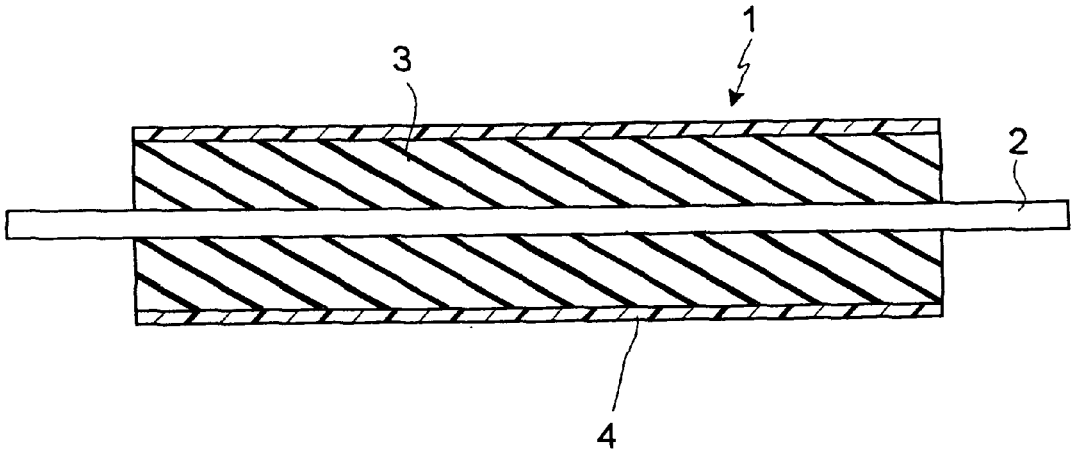
FIG. 1 is a schematic sectional view showing the toner carrier pertaining to one embodiment of the present invention.

As FIG. 1 shows, the toner carrier of the present invention is usually composed of a shaft 2 of good conductor, an electrically conductive elastic layer 3 formed thereon, and a coating layer 4 formed thereon. According to the present invention, the coating layer 4 contains a siloxane-crosslinked acrylic resin obtained from an acrylic copolymer with an alkoxysilyl group by crosslinking and curing.

The shaft 2 is not specifically restricted so long as it is made of a good conductor. It is usually a cylindrical solid or hollow metal shaft.

On the shaft 2 is formed the electrically conductive elastic layer 3. It is made of an elastomer incorporated with a conducting material. The elastomer is not specifically restricted. It includes, for example, nitrile rubber, ethylene propylene rubber, styrene butadiene rubber, butadiene rubber, isoprene rubber, natural rubber, silicone rubber, urethane rubber, acrylic rubber, chloroprene rubber, butyl rubber, and epichlorohydrin rubber. They may be used alone or in combination with one another. Preferable among these examples are nitrile rubber, urethane rubber, acrylic rubber, and epichlorohydrin rubber, used alone or in the form of blend with other rubber (such as ethylene propylene rubber). They exhibit good adhesion with the siloxane-crosslinked acrylic resin forming the coating layer 4.

The electrically conductive elastic layer has its conductivity imparted or regulated by incorporation with a conducting material. The conducting material is divided into an ionic conducting material and an electron conducting material. The ion conducting material includes, for example, salts of ammonium and salts of alkali metal or alkaline earth metal. The former include perchlorate, chlorate, hydrochloride, bromate, iodate, fluoroborate, sulfate, ethylsulfate, carboxylate, and sulfonate of tetraethyl ammonium, tetrabutyl ammonium, lauryltrimethyl ammonium, stearyltrimethyl ammonium, octadecyltrimethyl ammonium, dodecyltrimethyl ammonium, hexadecyltrimethyl ammonium, benzyltrimethyl ammonium, and modified fatty acid dimethyl ethyl ammonium. The latter include perchlorate, chlorate, hydrochloride, bromate, iodate, fluoroborate, trifluoromethyl sulfate, and sulfonate of lithium, sodium, calcium, magnesium, etc.

The electron conducting material includes, for example, electrically conductive carbon (such as ketjen black and acetylene black), rubber carbon (such as SAF, ISAF, HAF, FEF, GPF, SRF, FT, and MT), acid-treated ink carbon, pyrolyzed carbon, graphite, electrically conductive metal oxide (such as tin oxide, titanium oxide, and zinc oxide), and metals (such as nickel and copper).

The conducting material may be used in any unrestricted amount. The ionic conducting material may be used in an amount of 0.01–5 parts by weight, preferably 0.05–2 parts by weight, for 100 parts by weight of the main component (such as rubber). The electron conducting material may be used in an amount of 1–50 parts by weight, preferably 5–40 parts by weight, for 100 parts by weight of the main component. The resistance of the conductive elastic layer may be adjusted to $10^3$–$10^{10}$ Ω·cm preferably $10^4$–$10^8$ Ω·cm. Incidentally, the conductive elastic layer may be incorporated with any known filler, vulcanizing agent, and other rubber additives, in addition to the above-mentioned conducting material, according to need.

The electrically conductive elastic layer 3 is not specifically restricted in hardness. However, it should preferably have a JIS-A hardness of not more than 60, particularly 25–55. With a JIS-A hardness higher than 60, 25 the toner carrier is so hard that it has a small area in contact with the photosensitive body etc., which prevents the formation of good images. Moreover, the toner carrier with a hard surface damages the toner, causing the toner to stick to the photosensitive body and the layer forming blade, which results in poor images. Conversely, with an excessively low hardness, the electrically conductive layer 3 experiences large friction with the photosensitive body and the layer forming blade, which results in jitter leading to poor images.

Since the electrically conductive elastic layer 3 is in contact with the photosensitive body and the layer forming blade during its use, it should preferably have a low permanent compression set, that is, not more than 20%, specifically not more than 10%. A desirable material from this point of view is polyurethane rubber which has a low permanent compression set.

Moreover, the electrically conductive elastic layer 3 may have a surface roughness of not more than 15 μm Rz, particularly 3–10 μm Rz, in terms of JIS 10-point average roughness. With a roughness larger than 15 μm Rz, it is necessary to form the coating layer 4 thick so that the toner carrier has a smooth surface. A thick coating layer leads to a hard surface of the toner carrier which damages the toner, causing the damaged toner to stick to the photosensitive body and the layer forming blade, giving rise to poor images. By contrast, if the electrically conductive elastic layer 3 has a surface with excessively small roughness, the resulting toner carrier has a coating layer which is too smooth to hold the toner sufficiently. This leads to a decreased image density.

The coating layer 4 is formed to permit the toner carrier to be properly charged for attraction of the toner, to reduce friction of the toner carrier with the photosensitive body and the layer forming blade, and to protect the photosensitive body from contamination. According to the present invention, the coating layer 4 is formed from a siloxane-crosslinked acrylic resin obtained from an acrylic copolymer with an alkoxysilyl group by crosslinking and curing.

The acrylic copolymer with an alkoxysilyl group is one which gives rise to a siloxane-crosslinked acrylic resin upon hydrolysis of alkoxysilyl group and ensuing silanol condensation reaction which forms the —SiOSi— crosslinked structure for curing. A preferred example of the acrylic copolymer with an alkoxysilyl group is one which has the alkoxysilyl group represented by the formula (1) below.

(1)

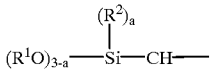

(where $R^1$ denotes a $C_{1-10}$ alkyl group; $R^2$ denotes a hydrogen atom or a monovalent hydrocarbon group selected from $C_{1-10}$ alkyl group, aryl group, and aralkyl group; and a denotes 0, 1, or 2.)

The alkoxysilyl group would be poor in reactivity if $R^1$ in the formula (1) above is an alkyl group having more than 10 carbon atoms or any other group (such as phenyl group and benzyl group) than alkyl group. The alkyl group ($R^1$) should preferably be one which has 1–4 carbon atoms. Examples of the alkyl group include methyl group, ethyl group, n-propyl group, i-propyl group, n-butyl group, and i-butyl group. $R^2$ is a hydrogen atom, or a $C_{1-10}$, preferably $C_{1-4}$ alkyl group, aryl group, or aralkyl group. Examples of the alkyl group include methyl group, ethyl group, n-propyl group, i-propyl group, n-butyl group, and i-butyl group. Examples of the aryl group include phenyl group. Examples of the aralkyl group include benzyl group.

The alkoxysilyl group represented by the formula (1) above is exemplified by those groups contained in the alkoxysilyl group-containing monomers shown below. The alkoxysilyl group-containing acrylic copolymer used in the present invention is obtained by copolymerization of the alkoxysilyl group-containing monomer with acrylic acid or methacrylic acid or a derivative thereof.

The alkoxysilyl group-containing monomer is not specifically restricted so long as it has a polymerizable unsaturated double bond. Its examples are given below.

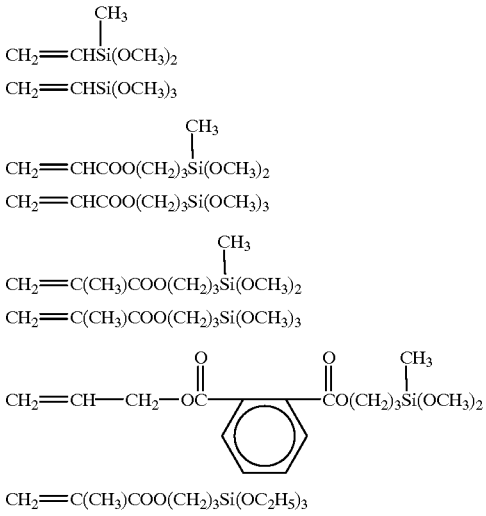

-continued

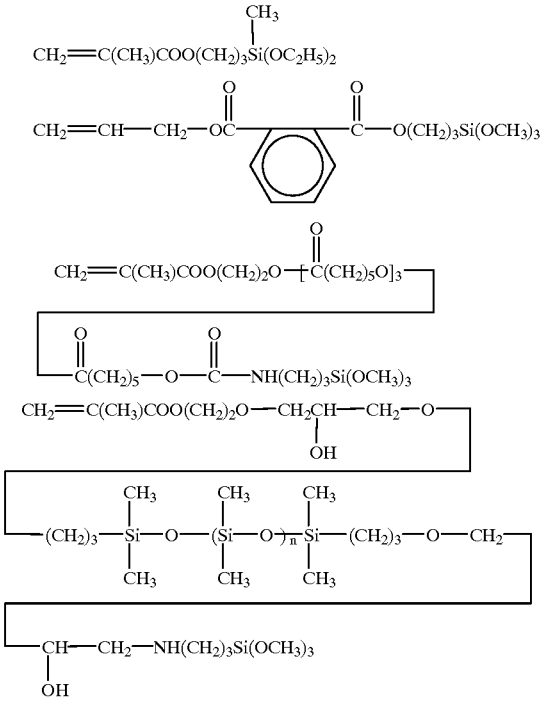

(where *n* denotes an integer of 0–20.)

The alkoxysilyl group-containing monomers shown above may be used alone or in combination with one another. The alkoxysilyl group-containing acrylic copolymer should preferably contain the unit derived from the alkoxysilyl group-containing monomer in a ratio of 2–90%, more preferably 3–70%, from the standpoint of curability and durability of the resulting coating film.

As mentioned above, the alkoxysilyl group-containing monomer is copolymerized with acrylic acid or methacrylic acid, or a derivative thereof to give the alkoxysilyl group-containing acrylic copolymer. Examples of the derivative include methyl (meth)acrylate, ethyl (meth)acrylate, butyl (meth)acrylate, 2-ethylhexyl (meth)acrylate, stearyl (meth) acrylate, benzyl (meth)acrylate, cyclohexyl (meth)acrylate, trifluoroethyl (meth)acrylate, pentafluoropropyl (meth) acrylate, perfluorocyclohexyl (meth)acrylate, (meth) acrylonitrile, glycidyl (meth)acrylate, dimethylaminoethyl (meth)acrylate, diethylaminoethyl (meth)acrylate, (meth) acrylamide, α-ethyl(meth)acrylamide, N-butoxymethyl (meth)acrylamide, N,N-dimethylacrylamide, N-methylacrylamide, acryloylmorpholine, 2-hydroxyethyl (meth)acrylate, 2-hydroxypropyl (meth)acrylate, and N-methylol (meth)acrylamide. Additional examples include "Aronix M-5700" (from Toagosei), macromers such as AS-6, AN-6, AA-6, AB-6, and AK-5 (from Toagosei), Placcel FA-1, FA-4, FM-1, and FM-4 (from Daicel), (meth) acrylate having urethane bonds or siloxane bonds, and phosphate ester-containing vinyl compound which is a condensation product of hydroxyalkylester of α,β-ethylenically unsaturated carboxylic acid (such as (meth)acrylic acid) and phosphoric acid or phosphate ester. Incidentally, the hydroxyl group-containing monomer should preferably be used in a small amount (e.g., less than 5 wt % of the copolymer).

The alkoxysilyl-containing acrylic copolymer used in the present invention may contain those units formed by urethane bond or siloxane bond with the main chain in an amount less than 50%. In addition, it may also contain other units which are derived from other monomers than the above-mentioned (meth)acrylic acid. Examples of such monomers are:

Vinyl compounds of aromatic hydrocarbon, such as styrene, α-methylstyrene, chlorostyrene, styrenesulfonic acid, 4-hydroxystyrene, and vinyltoluene.

Unsaturated carboxylic acid (such as maleic acid, fumaric acid, and itaconic acid), salts thereof (such as alkali metal salt, ammonium salt, and amine salt), and anhydride thereof (such as maleic anhydride).

Esters of unsaturated carboxylic acid (such as diester or half ester with a $C_{1-20}$ straight chain or branched alcohol).

Vinyl esters and allyl compounds (such as vinyl acetate, vinyl propionate, and diallyl phthalate).

Amino group-containing vinyl compounds (such as vinylpyridine and aminoethyl vinyl ether).

Amide group-containing vinyl compounds (such as diamide itaconate, crotonamide, diamide maleate, diamide fumarate, and N-vinylpyrrolidone).

Other vinyl compounds (such as 2-hydroxyethyl vinyl ether, methyl vinyl ether, cyclohexyl vinyl ether, vinyl chloride, vinylidene chloride, chloroprene, propylene, butadiene, isoprene, fluoroolefin, maleimide, N-vinylimidazole, and vinylsulfonic acid.

The above-mentioned alkoxysilyl-containing monomer and the above-mentioned acrylic acid, methacrylic acid, or a derivative thereof are copolymerized by any known process to give the alkoxysilyl-containing acrylic copolymer. A preferred process (for ease of synthesis) is solution polymerization which employs an azo radical initiator such as azobisisobutyronitrile.

The synthesis of the alkoxysilyl group-containing acrylic polymer by solution polymerization may employ a chain transfer agent, according to need, to control the molecular weight. Examples of the chain transfer agent include n-dodecylmercaptan, t-dodecylmercaptan, n-butylmercaptan, γ-mercaptopropyltrimethoxysilane, γ-mercaptopropyltriethoxysilane, γ-mercaptopropylmethyldimethoxysilane, and γ-mercaptopropylmethyldiethoxysilane. Additional examples are those compounds represented by the formulas below. The γ-mercaptopropyltrimethoxysilane as a chain transfer agent having an alkoxysilyl group in the molecule permits the introduction of an alkoxysilyl group into the terminal of the alkoxysilyl-containing acrylic copolymer.

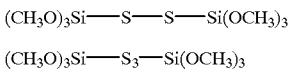

The above-mentioned solution polymerization may employ any one of the following non-reactive solutions. Hydrocarbons (such as toluene, xylene, n-hexane, and cyclohexane), acetic esters (such as ethyl acetate and butyl acetate), alcohols (such as methanol, ethanol, isopropanol, and n-butanol), ethers (ethyl cellosolve, butyl cellosolve, and cellosolve acetate), and ketones (such as methyl ethyl ketone, ethyl acetoacetate, acetylacetone, diacetone alcohol, methyl isobutyl ketone, and acetone).

The alkoxysilyl group-containing acrylic copolymer used in the present invention may be obtained by the process mentioned above. It may also be commercially available under a trade name of "Zemrac" YC3372, YC3322, and YC3315 (from Kanegafuchi Chemical Industry Co., Ltd.). These copolymers may be used alone or in combination with one another.

The toner carrier of the present invention is composed of the core layer and the coating layer 4 formed thereon, which is formed from the siloxane-crosslinked acrylic resin obtained by crosslinking from the alkoxysilyl group-containing acrylic copolymer. The alkoxysilyl group-containing acrylic copolymer undergoes hydrolysis of alkoxysilyl group and ensuing silanol condensation reaction to form the —SiOSi— crosslink structure for curing. This curing reaction usually needs a curing catalyst.

Examples of the curing catalysts are listed below.

Organotin compounds (such as dibutyltin dilaurate, dibutyltin dimaleate, dioctyltin dilaurate, dioctyltin dimaleate, dioctyltin maleate polymer, and tin octylate).

Phosphoric acid and phosphate esters (such as phosphoric acid, monomethyl phosphate, monoethyl phosphate, monobutyl phosphate, monooctyl phosphate, monodecyl phosphate, dimethyl phosphate, diethyl phosphate, dibutyl phosphate, dioctyl phosphate, and didecyl phosphate).

Propylene oxide, butylene oxide, cyclohexene oxide, glycidyl methacrylate, glycidol, acrylglycidyl ether, γ-glycidoxypropyltrimethoxysilane, γ-glycidoxypropyltriethoxysilane, and γ-glycidoxypropylmethyldimethoxysilane.

Compound represented by the formula (2) below, and addition products of an epoxy compound and phosphoric acid and/or acid phosphate monoester. (Epoxy compounds include Cardula E, Epikote 828, and Epikote 1001, from Yuka-Shell Epoxy Co., Ltd.)

Organic titanate compounds.

Organoaluminum compounds, such as tris(ethylacetoacetate)aluminum and tris(acetylacetonate) aluminum.

Organozirconium compounds, such as tetrabutyl zirconate, tetrakis(acetylacetonate)zirconium, tetraisobutylzirconate, and butoxytris(acetylacetonate) zirconium.

Acidic compounds, such as maleic acid, adipic acid, azelaic acid, sebacic acid, itaconic acid, citric acid, succinic acid, phthalic acid, trimellitic acid, pyromellitic acid, acid anhydride thereof, and paratoluenesulfonic acid.

Amines, such as hexylamine, di-2-ethylhexylamine, N,N-dimethyldodecylamine, and dodecylamine.

Mixtures or reaction products of these amines and acid phosphate ester.

Alkaline compounds, such as sodium hydroxide and potassium hydroxide. They may be used alone or in combination with one another.

(2)

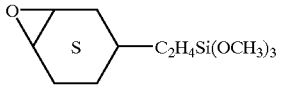

Preferable among these curing catalysts are organotin compound, acid phosphate ester, mixture or reaction product of acid phosphate ester and amine, saturated or unsaturated polybasic carboxylic acid and anhydride thereof, reactive silicon compounds, organotitanate compound, organoaluminum compound, organozirconium compound, and mixtures thereof. They are desirable because of their high activity.

The curing catalyst may be used in any unrestricted amount; however, a desirable amount is 0.1–20 parts by weight, particularly 0.1–10 parts by weight, for 100 parts by weight of the alkoxysilyl group-containing acrylic copolymer mentioned above and the hydroxyl group-containing acrylic resin mentioned later.

When the alkoxysilyl group-containing acrylic copolymer is crosslinked to give the siloxane-crosslinked acrylic resin, it may be mixed with the hydroxyl group-containing acrylic resin for co-crosslinking. The resulting product gives the coating layer 4 having improved weathering resistance, chemical resistance, and water resistance.

The hydroxyl group-containing acrylic resin is not specifically restricted; however, the one having a number-average molecular weight of 1500–40000, particularly 3000–25000, is desirable because of the physical properties (e.g., durability) of the coating film. Moreover, it should preferably have hydroxyl groups sufficient for crosslinking; the one having a hydroxyl value of 10–300 mg KOH/g, particularly 30–150 mg KOH/g, is desirable because of the physical properties (strength and durability) of the coating film.

Such hydroxyl group-containing acrylic resins may be obtained by copolymerization of hydroxyl group-containing vinyl monomer with acrylic acid, methacrylic acid, or a derivative thereof.

The hydroxyl group-containing vinyl monomer mentioned above is exemplified below.

2-hydroxyethyl (meth)acrylate, 2-hydroxypropyl (meth) acrylate, 2-hydroxyethylvinyl ether, N-methylol (meth) acrylamide, "Aronix" 5700 (from Toagosei), 4-hydroxystyrene, acrylate ester oligomer with terminal hydroxyl groups (HE-10, HE-20, HP-10, and HP-20 (from Nippon Shokubai)), "Premmer" (from Nippon Oil & Fats), and ϵ-caprolactone-modified hydroxyalkyl vinyl monomer as a reaction product of a hydroxyl group-containing vinyl compound and ϵ-caprolactone.

"Premmer" comes under the following designations. Premmer PP series (polypropylene glycol methacrylate), Premmer PE series (polyethylene glycol monomethacrylate), Premmer PEP series (polyethylene glycol-polypropylene glycol methacrylate), Premmer AP-400 (polypropylene glycol monoacrylate), Premmer AE-350 (polyethylene glycol monoacrylate), Premmer NKH-5050 (polypropylene glycol polytrimethylene monoacrylate), and Premmer GLM (glycerol monomethacrylate).

Some typical examples of ϵ-caprolactone-modified hydroxyalkyl vinyl monomer are those which are represented by the formula (3) below. They are commercially available under the following trade names. "Placcel" FA-1 (R=H, n=1), FA-4 (R=H, n=4), FM-1 (R=$CH_3$, n=1), and FM-4 (R=$CH_3$, n=4) from Daicel Chemical; and TONE M-100 (R=H, n=2) and TONE M-201 (R=$CH_3$, n=1) from UCC.

The ϵ-caprolactone-modified hydroxyalkyl vinyl monomer used as the hydroxyl group-containing vinyl monomer gives a coating film with improved impact resistance and flexibility.

(3)

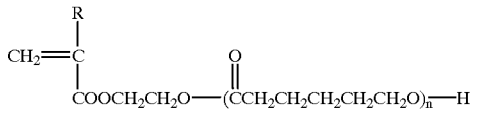

(where R denotes H or $CH_3$, and n denotes an integer of 1 and above.)

These hydroxyl group-containing vinyl monomers may be used alone or in combination with one another.

The hydroxyl group-containing vinyl monomer may be copolymerized with acrylic acid, methacrylic acid or derivatives thereof which are exemplified below.

Methyl (meth)acrylate, ethyl (meth)acrylate, butyl (meth) acrylate, 2-ethylhexyl (meth)acrylate, stearyl (meth) acrylate, benzyl (meth)acrylate, cyclohexyl (meth) acrylate, trifluoroethyl (meth)acrylate, pentafluoropropyl (meth)acrylate, perfluorocyclohexyl (meth)acrylate, (meth)acrylonitrile, glycidyl (meth)acrylate, dimethylaminoethyl (meth)acrylate, diethylaminoethyl (meth) acrylate, (meth)acrylamide, α-ethyl-(meth)acrylamide, N-butoxymethyl (meth)acrylamide, N,N-dimethylacrylamide, N-methylacrylamide, acryloylmorpholine, and N-methylol (meth)acrylamide. Additional examples include macromers such as AS-6, AN-6, AA-6, AB-6, and AK-5 (from Toagosei), (meth) acrylate having urethane bonds or siloxane bonds, and phosphate ester-containing vinyl compound which is a condensation product of hydroxyalkyl ester of α,β-ethylenically unsaturated carboxylic acid (such as (meth) acrylic acid) and phosphoric acid or phosphate ester.

The hydroxyl group-containing acrylic resin (or the copolymer of the hydroxyl group-containing vinyl monomer and acrylic acid, methacrylic acid, or a derivative thereof) may contain those units which are connected to the main chain through urethane bond or siloxane bond, or those units which are derived from other monomers than the derivatives of (meth)acrylic acid, so long as their amount is less than 50%. Examples of such monomers are:

Vinyl compounds of aromatic hydrocarbon, such as styrene, α-methylstyrene, chlorostyrene, styrenesulfonic acid, and vinyltoluene.

Unsaturated carboxylic acid (such as maleic acid, fumaric acid, and itaconic acid), salts thereof (such as alkali metal salt, ammonium salt, and amine salt), and anhydride thereof (such as maleic anhydride).

Esters of unsaturated carboxylic acid (such as diester or half ester with a $C_{1-20}$ straight chain or branched alcohol).

Vinyl esters and allyl compounds (such as vinyl acetate, vinyl propionate, and diallyl phthalate).

Amino group-containing vinyl compounds (such as vinylpyridine and aminoethyl vinyl ether).

Amide group-containing vinyl compounds (such as diamide itaconate, crotonamide, diamide maleate, diamide fumarate, and N-vinylpyrrolidone).

Other vinyl compounds (such as methyl vinyl ether, cyclohexyl vinyl ether, vinyl chloride, vinylidene chloride, chloroprene, propylene, butadiene, isoprene, fluoroolefin, maleimide, N-vinylimidazole, and vinylsulfonic acid.

The hydroxyl group-containing acrylic resin should preferably be prepared by solution polymerization which employs an azo radical initiator (such as azobisisobutyronitrile) for easy synthesis. For molecular weight control, a chain transfer agent may be used, such as n-dodecylmercaptan, t-dodecylmercaptan, and n-butylmercaptan. The solvent for polymerization is not specifically restricted so long as it is non-reactive. Moreover, the hydroxyl group-containing acrylic resin may be in the form of non-aqueous dispersion consisting of insoluble polymer particles dispersed in a non-polar organic solvent such as heptane and pentane.

The hydroxyl group-containing acrylic resin may be used alone or in combination with its other kind. The ratio of the hydroxyl group-containing acrylic resin to the alkoxysilyl group-containing acrylic copolymer is not specifically restricted; however, it should preferably be from 9/1 to 1/9, particularly from 8/2 to 2/8, by weight. With a ratio in excess of 9/1, the resulting coating layer would be so poor in durability as to achieve the object of the present invention. With a ratio smaller than 1/9, the hydroxyl group-containing acrylic resin does not produce its effect.

The toner carrier of the present invention has the coating layer 4 which is formed from the siloxane-crosslinked acrylic resin obtained from the alkoxysilyl group-containing acrylic copolymer by crosslinking for curing. The coating layer may be incorporated with some additives (exemplified below) for decrease in friction, adhesion, and surface energy, and also for control of electrification, electrostatic capacity, and resistance. (The siloxane-crosslinked acrylic resin functions as a binder.)

Resins (such as urethane resin, fluorocarbon resin, polyamide, polyester, alkyd resin, melamine resin, phenolic resin, epoxy resin, acrylic resin, acrylsilicone resin, acrylurethane resin, silicone resin, amino resin, urea resin, chlorinated polyethylene, ethylene-vinyl acetate resin, ethylene-ethyl acrylate resin, and polyvinyl butyral resin), conducting material (such as carbon powder, metal powder, metal oxide powder, and ionic substance), slip agent (such as fluorocarbon plastics, silicone, molybdenum sulfide and graphite in the form of fine particles), and charge-control agent. Examples of the conducting material may also include those which were listed above for the electrically conductive elastic layer 3.

The coating layer 4 may be formed on the electrically conductive elastic layer by any process which is not specifically restricted. A desirable process is by coating (such as dipping, roll coating, knife coating, and spraying) with a solution or dispersion containing the alkoxysilyl group-containing acrylic copolymer, curing catalyst, hydroxyl group-containing acrylic resin (optional), and other additives. Coating is followed by drying (at room temperature or 50–170° C.) for curing. Solvents for the solution or dispersion include alcohols (such as methanol, ethanol, isopropanol, and butanol), ketones (such as acetone, methyl ethyl ketone and cyclohexanone), aromatic hydrocarbons (such as toluene and xylene), aliphatic hydrocarbons (such as hexane), alicyclic hydrocarbons (such as cyclohexane), esters (such as ethyl acetate), ethers (such as isopropyl ether and tetrahydrofuran), amides (such as dimethylsulfamide), halogenated hydrocarbons (such as chloroform and dichloroethane), and mixtures thereof.

The coating layer 4 is not specifically restricted in thickness; however, it is usually 1–100 $\mu$m thick, preferably 5–30 $\mu$m thick. In addition, the coating layer 4 is not specifically restricted in resistance. However, it usually has a little higher resistance than the electrically conductive elastic layer 3 so as to facilitate transfer of electric charge to and from toner and application of potential bias. A desirable resistance is usually $10^9$–$10^{16}$ Ω·cm, particularly $10^{10}$–$10^{15}$ Ω·cm.

As mentioned above, according to the present invention, the coating layer 4 is composed of a siloxane-crosslinked acrylic resin (obtained from alkoxysilyl group-containing acrylic copolymer) and optional additives incorporated into the siloxane-crosslinked acrylic resin as a binder. The coating layer 4 should preferably contain a limited amount of soluble matter of not more than 30%, particularly not more than 10%, which can be extracted by a solvent, such as methyl ethyl ketone and toluene, which readily dissolves the alkoxysilyl group-containing acrylic copolymer as the raw material. The amount of soluble matter is proportional to the amount of components with a comparatively low molecular weight and the amount of components which are not completely cured. The coating layer containing such components brings about contamination of the photosensitive body, aggregation of toner, staining with toner, wearing of the coating layer, and increase in friction. Incidentally, the amount of soluble matter can be obtained from the equation below.

$$\text{Soluble matter}=(A-B)/A\times 100\ (\%)$$

(where A is the weight before solvent extraction, and B is the weight after solvent extraction.) The toner carrier 1 having the coating layer 4 formed thereon has a resistance which is properly established according to the type and construction of the image-forming apparatus equipped with the toner carrier 1. The resistance is usually $10^6$–$10^{12}$ Ω·cm, particularly $10^7$–$10^{10}$ Ω·cm. In addition, the toner carrier 1 having the coating layer 4 formed thereon is not specifically restricted in surface roughness; however, it should preferably have a surface roughness of not more than 10 $\mu$m Rz, particularly 1–8 $\mu$m Rz, in terms of JIS 10-point average roughness. With a surface roughness larger than 10 $\mu$m Rz, the toner carrier will cause fogging due to insufficiently charged toner or inversely charged toner. Conversely, with an excessively small surface roughness, the toner carrier will cause low image density due to insufficient toner-carrying capability.

The toner carrier of the present invention is used as a development roll in an image-forming apparatus such as development unit for electrophotography. The toner carrier in use is shown in FIG. 2. The toner carrier (as the development roll 1) is arranged between the toner application roll 5 (which supplies a toner) and the photosensitive drum 6 (image-forming body) which holds an electrostatic latent image. The toner 7 is supplied to the development roll 1 by the toner application roll 5. The development roll 1 carries the toner 7 thereon. The toner 7 is made into a uniform thin layer by the layer forming blade 8. The thin layer of the toner is transferred to the photosensitive drum 6 (image-forming body). The toner sticks to the electrostatic latent image on the photosensitive drum 6 (image-forming body), thereby making the latent image visible. The image-forming apparatus shown in FIG. 2 is not explained in detail here because it was explained in the section of prior art technology.

The toner carrier of the present invention is not limited to the one in roll form as shown in FIGS. 1 and 2. It may take on any shape depending on the type and construction of the image-forming apparatus in which it is incorporated. Further, the image-forming apparatus equipped with the toner carrier of the present invention is not limited to the one shown in FIG. 2 so long as it is constructed such that the toner carrier carries a toner thereon, forming a thin layer of toner, and touches or approaches the image-forming body, thereby supplying the toner to the surface of the image-forming body and forming a visible image on the surface of the image-forming body. For example, it would be possible to construct an image-forming apparatus which works in such a way that the toner being carried by the toner carrier is allowed to fly through holes made in the control electrode directly onto paper or OHP sheet as the image-forming body, thereby directly forming an image thereon.

EXAMPLE

The invention will be described in more detail with reference to the following examples, which are not intended to restrict the scope thereof.

Example 1

A polyol composition was prepared by mixing from 100 pbw (parts by weight) of polyether polyol (OH value=33, molecular weight=5000) prepared by adding propylene oxide and ethylene oxide to glycerin, 1.0 pbw of 1,4-butanediol, 1.5 pbw of silicone surfactant, 0.5 pbw of nickel acetylacetonate, 0.01 pbw of dibutyltin dilaurate, and 2.0 pbw of acetylene black.

After defoaming by stirring under reduced pressure, the polyol composition was stirred for 2 minutes with 17.5 pbw of urethane-modified MDI. The resulting mixture was cast into a mold (preheated at 110° C.) in which a metal shaft had been placed. After curing at 110° C. for 2 hours, there was obtained a roll made up of a metal shaft and an electrically conductive elastic layer formed thereon. The surface of the roll was polished so that it has a surface roughness of 7 μm Rz (in terms of JIS 10-point average roughness). The surface roughness was measured using a surface roughness meter "Surfcom 590A" (from Tokyo Seimitsu).

A coating material of the composition as shown in Table 1 was prepared from "Zemlac YC3372" (alkoxysilyl group-containing acrylic copolymer, from Kanegafuchi Chemical), "Zemlac BT12OS" (organotin curing catalyst, from Kanegafuchi Chemical), and MEK (methyl ethyl ketone) as a solvent. In this coating material was dipped the above-mentioned roll. The coating material was heated at 110° C. for 6 hours for crosslinking and curing. Thus there was obtained a toner carrier in roll form which has a crosslinked (cured) coating layer, as shown in FIG. 1.

Example 2

The same procedure as in Example 1 was repeated to prepare a toner carrier in roll form, except that the coating material was incorporated with 9.0 pbw of carbon black "Printex 35" (from Degussa Japan) as a conducting agent.

Comparative Example 1

A coating material of the composition as shown in Table 1 was prepared from "Bekkolite M6402" (from Dainippon Ink and Chemicals) which is oil-free alkyd resin (50% solids) as a binder, "Superbekkamine L145" (from Dainippon Ink and Chemicals) which is melamine resin (60% solids), carbon black "Printex 35" (from Degussa Japan) as a conducting agent, and MEK (methyl ethyl ketone) as a solvent. A toner carrier in roll form was prepared in the same manner as in Example 1 except that the coating layer was formed from this coating material.

Comparative Example 2

The same procedure as in Comparative Example 1 was repeated to prepare a toner carrier in roll form, except that the coating layer was formed by drying at 90° C. for 6 hours.

The toner carriers obtained as mentioned above were tested as follows. The results are shown in Table 1.

Thickness of coating layer

The thickness of the coating layer was measured by observing the vertical cross section of the roller by a scanning electron microscope. All the samples measured were found to be about 15 μm thick.

Soluble matter in the coating layer

The coating solution used for the coating layer of the toner carrier was spread over a glass plate, and the coating film on the glass plate was heated for crosslinking (curing) under the same condition as used for the toner carrier. The cured coating film, together with the glass plate, was immersed in methyl ethyl ketone at room temperature for 24 hours. After drying, the coating film was weighed. The amount of soluble matter in the coating layer of the toner carrier was calculated from the equation below.

$$\text{Soluble matter}=(A-B)/A\times 100\ (\%)$$

(where A is the weight before solvent extraction, and B is the weight after solvent extraction.)

Resistance of coating layer

The coating solution used for the coating layer of the toner carrier was spread over a copper plate, and the coating film on the copper plate was heated for crosslinking (curing) under the same condition as used for the toner carrier. The cured coating film was measured for resistance (between the copper plate and the electrode placed on the coating film).

Resistance of the toner carrier

The toner carrier was pressed against a copper plate with a load of 500 g attached to each end thereof. A voltage of 100V was applied and resistance was measured using a resistance meter R8340A (from Advantest).

Amount of electric charge on toner

The toner carrier (as the development roll) was mounted on the development unit as shown in FIG. 2. It was turned at a circumferential speed of 50 mm/sec, so that a uniform thin layer of toner was formed thereon. The toner was sucked into a Faraday gage for measurement of charge amount.

Evaluation of image

The toner carrier (as the development roll) was mounted on the development unit as shown in FIG. 2. It was turned at a linear speed of 50 mm/sec for reversal development with a non-magnetic one-component toner having an average particle diameter of 7 μm, at a development bias of −400V and blade bias of −600V. The images were examined for quality (white, halftone, and black) before and after continuous 10000 runs.

TABLE 1

| | | Example 1 | Example 2 | Comparative Example 1 | Comparative Example 2 |
|---|---|---|---|---|---|
| Composition of coating material (pbw) | YC3372 | 50.0 | 50.0 | | |
| | BT120S | 5.0 | 5.0 | | |
| | M6402 | | | 112.0 | 112.0 |
| | L145 | | | 33.3 | 33.3 |
| | Printex 35 | | 9.0 | 15.2 | 15.2 |
| | MEK | 100 | 91.0 | 108.0 | 108.0 |
| Drying temperature (° C.) | | 110 | 110 | 110 | 90 |
| Coating layer | Soluble matter (%) | 6 | 8 | 18 | 22 |
| | Resistance (Ω · cm) | $3.2\times10^{14}$ | $6.4\times10^{10}$ | $7.9\times10^{13}$ | $1.3\times10^{14}$ |
| Resistance of roll (Ω) | | $3.9\times10^{8}$ | $4.6\times10^{7}$ | $2.0\times10^{8}$ | $2.5\times10^{8}$ |
| Amount of charge on toner (μC/g) | | −30 | 21 | −26 | −25 |
| Image quality (initial) | White image | good | good | good | good |
| | Halftone | good | good | good | good |
| | Black image | good | good | good | good |
| Image quality after 10000 runs | White image | good | good | fogging | fogging |
| | Halftone | good | good | harshness | good |
| | Black image | good | good | density variation | good |
| Appearance of roll after 10000 runs | | good | good | cracks and cuts in coating layer | toner filming |

It is noted from Table 1 that the toner carrier of the present invention gives good images (free of fogging in white area, harshness in halftone area, and density variation in black area) even after continuous 10000 runs. This demonstrates the good durability of the toner carrier over a long period of time.

What is claimed is:

1. A toner carrier which carries a toner in such a way as to form a thin layer of said toner on the surface thereof, touches or approaches an image-forming body with said toner carried thereon, and supplies said toner to the surface of said image-forming body, thereby forming a visible image on the surface of said image-forming body, wherein said toner carrier comprises an electrically conductive elastic layer and a coating layer formed thereon which contains a siloxane-crosslinked acrylic resin obtained from an acrylic copolymer with an alkoxysilyl group by crosslinking and curing.

2. A toner carrier as defined in claim 1, wherein the electrically conductive elastic layer has a resistance of $10^3$–$10^{10}$ Ω·cm.

3. A toner carrier as defined in claim 1, wherein the coating layer is electrically conductive and has a resistance of $10^9$–$10^{16}$ Ω·cm.

4. A toner carrier as defined in claim 1, wherein the coating layer contains soluble matter of not more than 30% when extracted with a solvent which dissolved the alkoxysilyl group-containing acrylic copolymer.

5. A toner carrier as defined in claim 1, wherein the coating layer has a thickness of 1 to 100 μm.

6. An image-forming apparatus which forms an image in such a way that a toner in the form of thin layer is carried by a toner carrier which touches or approaches an image-forming body and supplies said toner to the surface of said image-forming body, thereby forming a visible image on the surface of said image-forming body, wherein the toner carrier is the one which is defined in claim 1.

* * * * *